US007665819B2

(12) United States Patent
Nicodem

(10) Patent No.: US 7,665,819 B2
(45) Date of Patent: Feb. 23, 2010

(54) METHOD AND APPARATUS FOR A PRINTER CARTRIDGE TESTER

(75) Inventor: Harry E. Nicodem, Richmond, IL (US)

(73) Assignee: Tonerhead, Inc., McHenry, IL (US)

( * ) Notice: Subject to any disclaimer, the term of this patent is extended or adjusted under 35 U.S.C. 154(b) by 510 days.

(21) Appl. No.: 11/379,494

(22) Filed: Apr. 20, 2006

(65) Prior Publication Data

US 2007/0109340 A1 May 17, 2007

Related U.S. Application Data

(63) Continuation-in-part of application No. 11/373,026, filed on Mar. 10, 2006, now Pat. No. 7,303,249.

(60) Provisional application No. 60/673,513, filed on Apr. 21, 2005.

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/84, 85, 86; 701/33; 702/120; 399/24
See application file for complete search history.

(56) References Cited

U.S. PATENT DOCUMENTS 2,086,643 A 7/1937 Shearer
3,891,316 A 6/1975 Whited
4,207,611 A * 6/1980 Gordon ..... 701/33
4,489,414 A 12/1984 Titherley
4,694,408 A 9/1987 Zaleski
4,837,764 A 6/1989 Russello
4,953,165 A 8/1990 Jackson
4,964,124 A 10/1990 Burnett
5,001,655 A 3/1991 Higano et al.
5,173,855 A 12/1992 Nielson et al.
5,210,703 A 5/1993 Hodgson
5,270,774 A 12/1993 Kikuchi
5,357,519 A 10/1994 Martin et al.
5,432,705 A 7/1995 Severt et al.

(Continued)

OTHER PUBLICATIONS http://www.uci.net/~parti/jtmanual.pdf, "Jet Test User's Manual", 2000.*

(Continued)

*Primary Examiner*—Stephen D Meier
*Assistant Examiner*—Carlos A Martinez, Jr.
(74) *Attorney, Agent, or Firm*—Vedder Price PC

(57) ABSTRACT

A handheld device for testing printer cartridges interfaces with a computer for processing of test results. Multiple testing devices may be coupled to the computer. In one embodiment, each testing device includes a base board and an adaptor board. The base board includes a host processor and a computer interface. The adaptor board comprises a cartridge-specific socket for retaining a printer cartridge to be tested and test circuitry. The adaptor boards may be interchanged. The device may obtain power from the computer interface. A computer program communicates with the test device and displays the results of the tests through execution of a suitable application or program. The application may present a pass/fail indication to a user and tally the number of passed/failed cartridges. The device for testing printer cartridges may include a sensor for detecting cartridge information and a computer program for altering the cartridge identification.

16 Claims, 6 Drawing Sheets

U.S. PATENT DOCUMENTS

| | | | | |
|---|---|---|---|---|
| 5,501,518 | A * | 3/1996 | Woodward | 702/120 |
| 5,619,307 | A | 4/1997 | Machino | |
| 5,644,345 | A | 7/1997 | Toniolo | |
| 5,704,403 | A | 1/1998 | Schwenk et al. | |
| 5,729,555 | A | 3/1998 | Ichikava | |
| 5,768,495 | A | 6/1998 | Campbel et al. | |
| 5,877,793 | A | 3/1999 | Erickson | |
| 5,929,640 | A | 7/1999 | Tse et al. | |
| 6,199,969 | B1 | 3/2001 | Haflinger et al. | |
| 6,400,462 | B1 | 6/2002 | Hille | |
| 6,574,189 | B1 | 6/2003 | Ko et al. | |
| 6,586,945 | B1 | 7/2003 | Geurts | |
| 6,728,076 | B1 | 4/2004 | Ko et al. | |
| 6,850,716 | B2 | 2/2005 | Kurihara | |
| 6,938,984 | B2 | 9/2005 | German et al. | |
| 7,079,970 | B2 | 7/2006 | Nicodem et al. | |
| 7,324,763 | B2 * | 1/2008 | Pytlik | 399/24 |
| 2003/0191878 | A1 | 10/2003 | Shirley | |
| 2004/0040614 | A1 | 3/2004 | Sesek et al. | |
| 2004/0085379 | A1 | 5/2004 | Taylor et al. | |
| 2004/0240896 | A1 | 12/2004 | Ito et al. | |
| 2004/0256197 | A1 | 12/2004 | Blake et al. | |
| 2004/0257409 | A1 | 12/2004 | Cheok | |
| 2004/0263569 | A1 | 12/2004 | Ros et al. | |
| 2004/0263589 | A1 | 12/2004 | Ansier | |
| 2005/0029157 | A1 | 2/2005 | Gibeley et al. | |
| 2005/0034777 | A1 | 2/2005 | Nicodem et al. | |
| 2005/0039091 | A1 | 2/2005 | Hanaoka | |
| 2005/0264597 | A1 | 12/2005 | Asauchi et al. | |
| 2006/0007278 | A1 | 1/2006 | Holland et al. | |
| 2006/0012626 | A1 * | 1/2006 | Nlend et al. | 347/19 |
| 2006/0049837 | A1 | 3/2006 | Kim et al. | |
| 2006/0109320 | A1 | 5/2006 | Cutler et al. | |
| 2006/0152542 | A1 * | 7/2006 | Dispoto | 347/19 |
| 2006/0158686 | A1 | 7/2006 | Watanabe | |

OTHER PUBLICATIONS http://www.inksolution.net/product_info.php?cPath=22&products_id=29, Ink Solution catalog for P-T600 Tester for HP 500/600 cartridges, Oct. 28, 2003 webpage retrieved on Jan. 26, 2009.*

R-Jettek, Makro Mikro Circuit Testers, http://www.rjettek.com/AuxEquipment/circuittester.php , accessed Jul. 20, 2006.

* cited by examiner

METHOD AND APPARATUS FOR A PRINTER CARTRIDGE TESTER

CROSS-REFERENCE TO RELATED APPLICATION

The present patent application claims the benefit of U.S. Provisional Application No. 60/673,513, filed on Apr. 21, 2005, and entitled INKJET CARTRIDGE TESTER, which prior application is hereby incorporated by reference verbatim, and also claims the benefits as a continuation-in-part, where applicable, of U.S. patent application Ser. No. 11/373,026, filed on Mar. 10, 2006 now U.S. Pat. No. 7,303,249, and entitled METHOD AND APPARATUS FOR A PRINTER CARTRIDGE TESTER, with the same effect as though the prior application were fully and completely set forth herein.

FIELD OF THE INVENTION

The present invention generally relates to a devices and methods for testing printer cartridges and, in particular, to a testing device that communicates with a computer testing of printer cartridges.

BACKGROUND OF THE INVENTION

Printing devices, such as printers for use with computers, facsimile machines, and copiers, are typically sold with at least one, and in many cases, multiple ink cartridges. These cartridges include a housing that contains a reservoir of printing ink, either black or color, along with printer nozzles, which allow the ink to be transmitted to the intended medium and electrical contacts for communication between the printer and the cartridge.

Many such cartridges are intended to be disposable; when the cartridge is exhausted of ink, of course, printing becomes impossible. The emptied cartridge must be removed and a replacement cartridge must be substituted therefore to enable further printing. The disposable cartridge must then be disposed of in a proper fashion to reduce spillage of any remaining ink and to reduce any potential adverse environmental impact of the ink and other materials of the cartridge. Unless properly recycled, disposing of the empty cartridge increases the amount of garbage added to landfills.

In response to the negative environmental impact and cost disadvantages of disposable cartridges, refillable cartridges have been developed and welcomed by the marketplace. At present, these refillable cartridges may be refilled by the consumer by purchasing a refill kit including a syringe filled with ink and needle. In use, the cartridge is refilled by insertion of the needle into a refill port provided through the housing of the cartridge and emptying the syringe of ink into the reservoir of the cartridge. In practice, this is a less than ideal solution because this can be a messy procedure. Furthermore, the cartridge may have stopped functioning properly for reasons which are not related to the supply of ink and moreover, not diagnosable by the user.

Some cartridge manufacturers have devised a system to prevent users from refilling and reusing cartridges in a selected printer. Some cartridges, such as Hewlett Packard™ cartridge types 27 to 29 and 56 to 59, are equipped with a sense line where cartridge information identification is stored in addition to the ink level status. Some printers are programmed to either ignore any refilled cartridges with previously encountered information identification stored in the memory of the printer, or ignore the cartridges recently encountered and stored in the memory of the printer, even if the ink level status information has been updated to indicated the presence of ink in the cartridge.

Many cartridge manufacturers allow customers to return their empty cartridges to the manufacturer. The manufacturer then refills the cartridge and resells the refilled cartridge for a discounted price. Further, many companies obtain empty cartridges, refill them with ink and sell the refilled cartridges for a discounted price, creating competition and lower prices. Refilling an empty cartridge in this manner is a less expensive alternative, with a lesser amount of waste generated. There are numerous printer manufacturers, such as, for example, Hewlett Packard™, Lexmark™, Canon™, etc., and each manufactures multiple cartridges for the many printing devices. Each cartridge has a housing that contains a number of electrical contacts and print nozzles in various proprietary configurations, and is designed or configured such that it may only fit into a particular printing device and no other.

Generally, a printer cartridge comprises a print head that includes a number of microscopic chambers called nozzles. Ink flows from a reservoir in the cartridge into each of the nozzles by some combination of gravity and capillary action. Each nozzle has a small resistive element associated therewith that heats the ink, causing the ink to expand and be expelled from the nozzle. The ink flowing through the nozzle acts as a coolant. In use, the cartridges are properly inserted into a printing device which receives a signal in order to print on the medium. For example, a printer connected to a computer may receive a print signal from the computer, while a facsimile machine may receive a signal over a telephone line. The printing device converts that signal, depending on its driver program, and sends the appropriate control signal to the cartridge or, in the case of a color printing device, to multiple cartridges. Once the control signal is received, each cartridge transfers ink through its print nozzles as the medium passes beneath. When the control signal is complete, the printing device will have generated a document or drawing on the medium. Each use of the cartridge reduces the amount of toner or ink remaining in the cartridge. Depending on the size of the cartridge, a number of documents or drawings can be generated before the cartridge is empty or near empty. The larger the cartridge, the more ink it contains and the more documents can be printed. When empty, the cartridge needs to be replaced or reconditioned and/or refilled.

If the user operates a printer with an empty cartridge, the resistive heating elements in the cartridge may burn out (creating an open circuit) or draw high current (evidence of a short circuit). Because cartridges do fail in this manner, it is very advantageous for an inkjet cartridge re-manufacturer or the like to be able to test the electrical circuitry in a cartridge before refilling it, which reduces loss risks related to the time and cost it takes to perform the refilling step and the cost of the ink if the cartridge is defective and must be discarded. Furthermore, prior art testing devices that are currently available are either costly, complex, and require an AC line voltage power source or stand alone, handheld devices, that have a built in display, provide limited test results information, and require factory servicing to replace the battery power source.

A demand therefore exists for a device and method that allows a user to test a printer cartridge, that is inexpensive and is easily adaptable to various test applications depending on cartridge configuration, a device and method that is able to bypass any printer information identification to prevent refill operations, and that is convenient and reliable.

SUMMARY OF THE INVENTION

In light of the above, the instant disclosure describes an automatic inkjet cartridge testing device and system that is comprised of an arrangement of mechanical, electrical and electronic, and software elements that can be used by a user to test inkjet cartridges of various manufacture that are used in printing devices, such as printers connected to computers, facsimile machines and copiers. The present invention includes a handheld device for testing printer cartridges and that interfaces with a computer for processing of test results via a computer interface. Preferably, the device obtains power from this connection thereby eliminating the need for batteries or additional power sources. In one aspect of the present invention, the computer program communicates with the test device and displays the results of the tests through execution of a suitable application or program. In a presently preferred embodiment, the application presents a pass/fail indication to a user, tallies the number of passed/failed cartridges, and allows the user to enter data such as company name, date, etc., to track the origin of the cartridges or for general accounting purposes.

In another embodiment of the present invention, the testing device includes a base board and an adaptor board. The base board includes a host processor, such as a microcontroller, and the computer interface. The adaptor board comprises a printer cartridge capturing fixture or socket and test circuitry. Preferably, the adaptor board couples to the base board via complementary connectors that also allow communication between the boards.

In yet another embodiment of the present invention, the device for testing printer cartridges includes a sensor for detecting cartridge information and a computer program for altering the cartridge identification to override any printer identification of the cartridge previously placed in said printer.

BRIEF DESCRIPTION OF THE DRAWINGS

The features of the present invention are set forth with particularity in the appended claims. The invention itself, together with further features and attendant advantages, will become apparent from consideration of the following detailed description, taken in conjunction with the accompanying drawings. An embodiment of the invention is now described, by way of example only, with reference to the accompanying drawings wherein like reference numerals represent like elements and in which:

DETAILED DESCRIPTION OF THE PRESENT EMBODIMENTS

Figure 1:
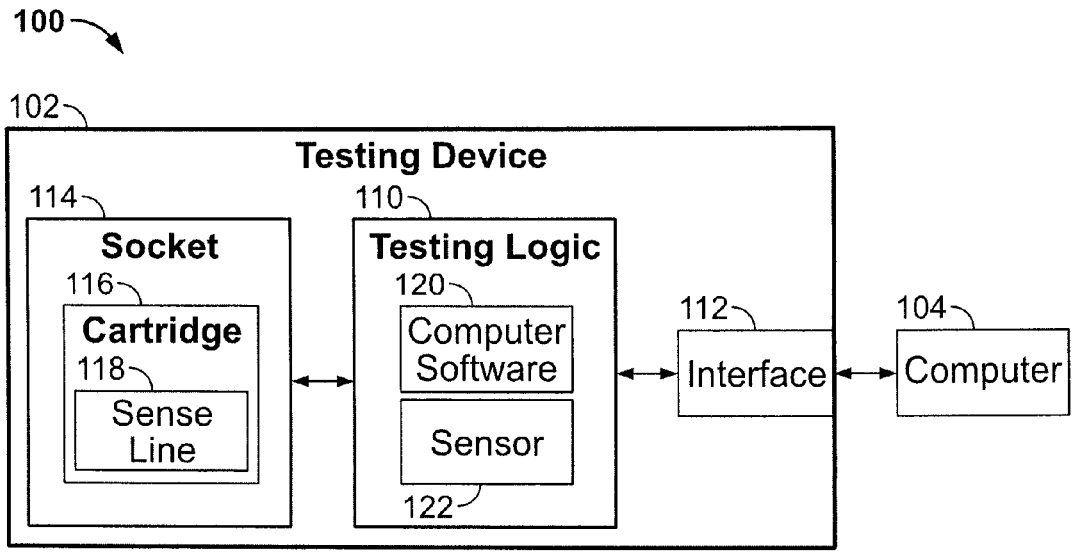
FIG. 1 is a schematic block diagram of a system for testing printer cartridges in accordance with the present invention.

Referring now to the drawings, FIG. 1 illustrates a system 100 for testing printer cartridges in accordance with the present invention. As shown, the system 100 comprises a testing device 102 in communication with a computer 104. Although a single testing device 102 is illustrated, it is understood that multiple testing devices in accordance with the present invention may be coupled to the computer 104. The computer 104 may comprise virtually any type of computing device such as a desktop computer, a portable computer, a personal digital assistant or any suitable computing device capable of diagnosing cartridge status. As described in greater detail below, the computer 104 typically comprises a processor coupled to suitable memory and various input/output devices such as a touch-screen display, various media drives, a keyboard, mouse, etc. Typically, various programs or applications can be stored in the memory of the computer to provide control of the system, video display for the user, prompting the entry of information, etc. In one aspect of the present invention, the computer 104 executes an application that may be used to interact with the testing device 102 and to display test results provided by the testing device 102. In another aspect of the present invention, the testing device 102 executes a computer program 120 that may be used for selectively altering the cartridge identification information found in a sense line 118 so as to override an empty reading by a sensor 122 when a recycled cartridge 116 is place in the testing device 102.

The testing device 102 generally comprises testing logic 110 in communication with a computer interface 112 and a socket 114. The testing logic 110, as described in greater detail below, encompasses all functionality of the testing device 102 related to the testing of a printer cartridge 116. The computer interface 112 provides and supports a communication path between the testing device 102 and the computer 104 (via its own interface component not shown). Preferably, power for the testing device 102 is provided from the computer via the computer interface 112. In a presently preferred embodiment, the computer interface 112 comprises a so-called Universal Serial Bus (USB) interface, although the present invention is not limited in this regard. The socket 114 is a receptacle that is sized and shaped to conform to and receive a predetermined type or family of printer cartridge 116 and functions to hold the cartridge 116. It is an aspect of the present invention that the testing device 102 is designed to accommodate and function with a variety of different interchangeable socket configurations to receive a variety of different printer cartridge designs.

Figure 2:
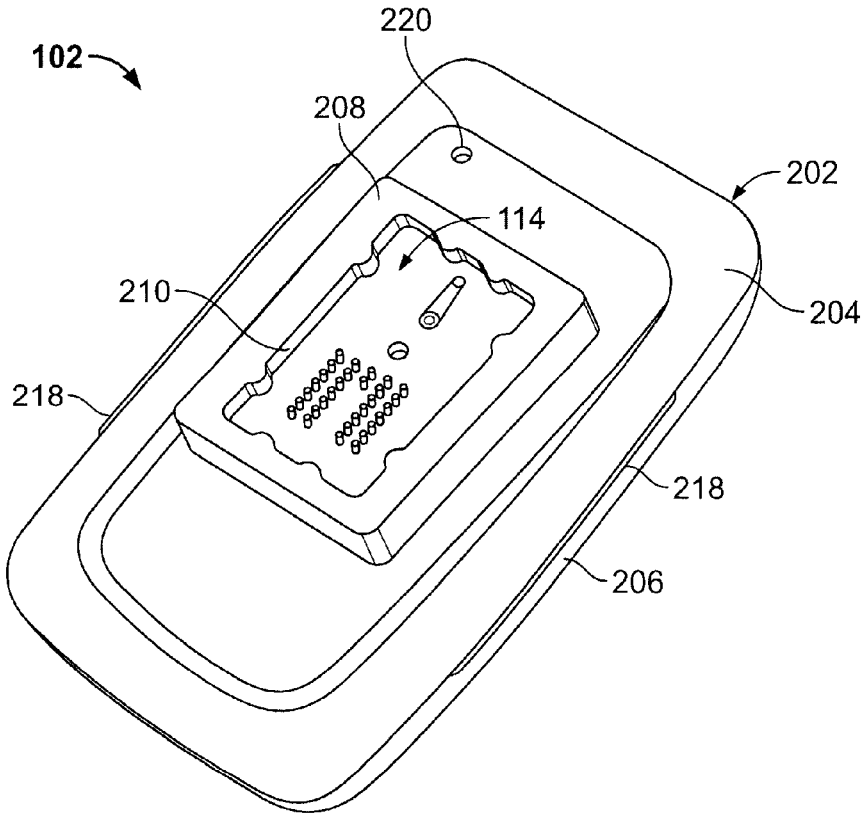
FIG. 2 is a perspective view of a printer cartridge testing device in accordance with an embodiment of the present invention.

Referring now to FIG. 2, a particular embodiment of a testing device 102 is illustrated. In particular, the illustrated testing device includes a tester case or housing 202 which includes an upper portion 204 and a lower portion 206. The upper portion 204 includes a cartridge receiving portion 208, which includes a opening 210 formed therethrough to provide a socket 114.

Figure 4:
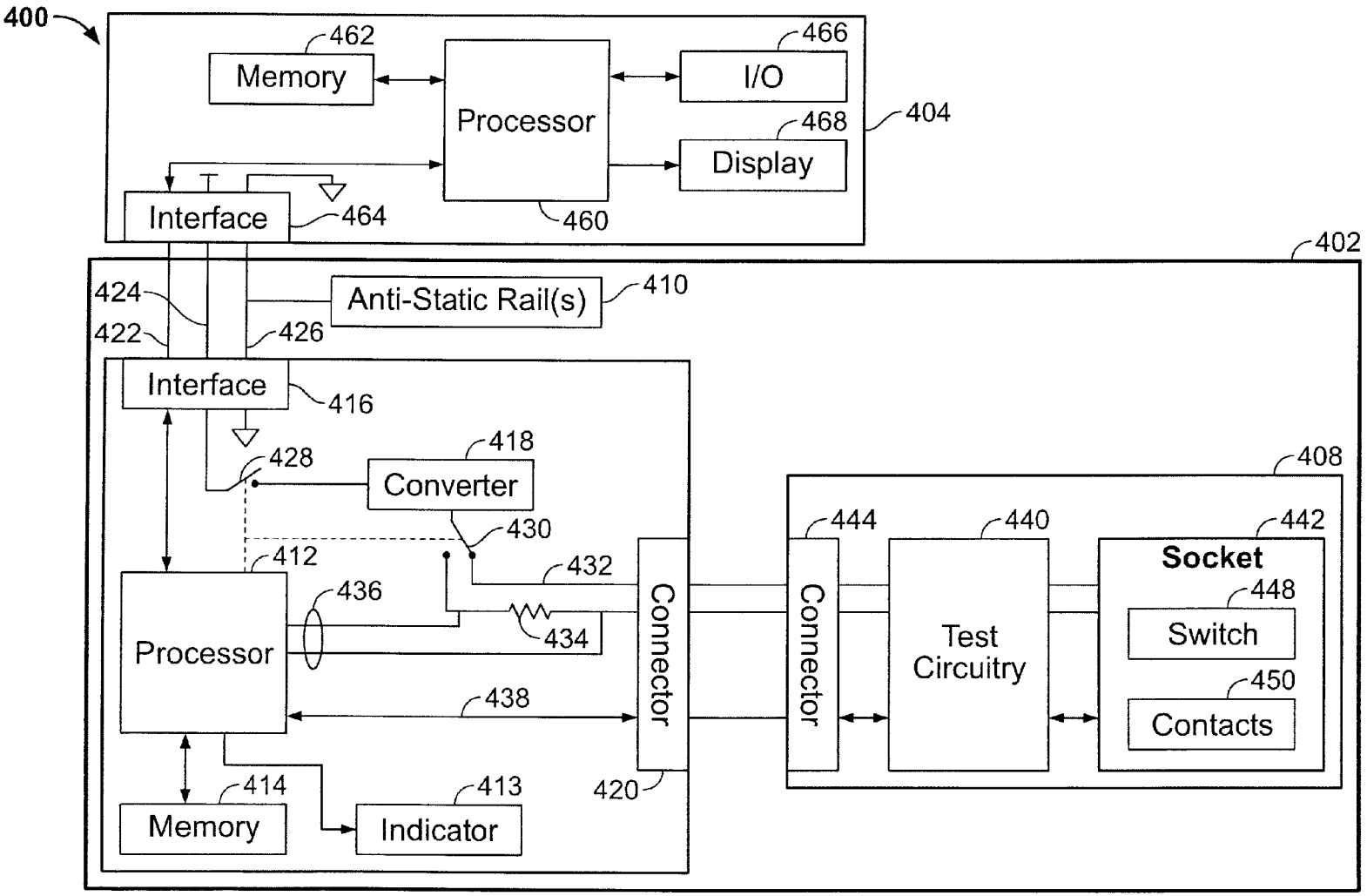
FIG. 4 is a schematic block diagram illustrating in greater detail various components of a system for testing printer cartridges in accordance with the present invention.

Each testing device 102 includes a pattern of holes 212 formed through the cartridge receiving portion 208, which align with electrical contacts on a printer cartridge when the printer cartridge is placed in the socket 114. Each hole 212 includes a conductive contact or pin 214 disposed therein, which may be brass or any suitable electrically conductive material and a conductive spring (not shown), which may be gold plated for conductivity and resistance to oxidation and positioned to bias a respective pin 214 in an upward condition. Each pin 214 is sized, shaped and positioned to contact a respective electrical pad on the printer cartridge. When each spring urges a pin 214 upwardly against a respective cartridge pad, it establishes electrical communication with circuitry inside the testing device (FIG. 4). In a presently preferred embodiment described in greater detail below, the pins 214 are disposed on a circuit board as known in the art, described hereinafter as an adaptor board.

Figure 3:
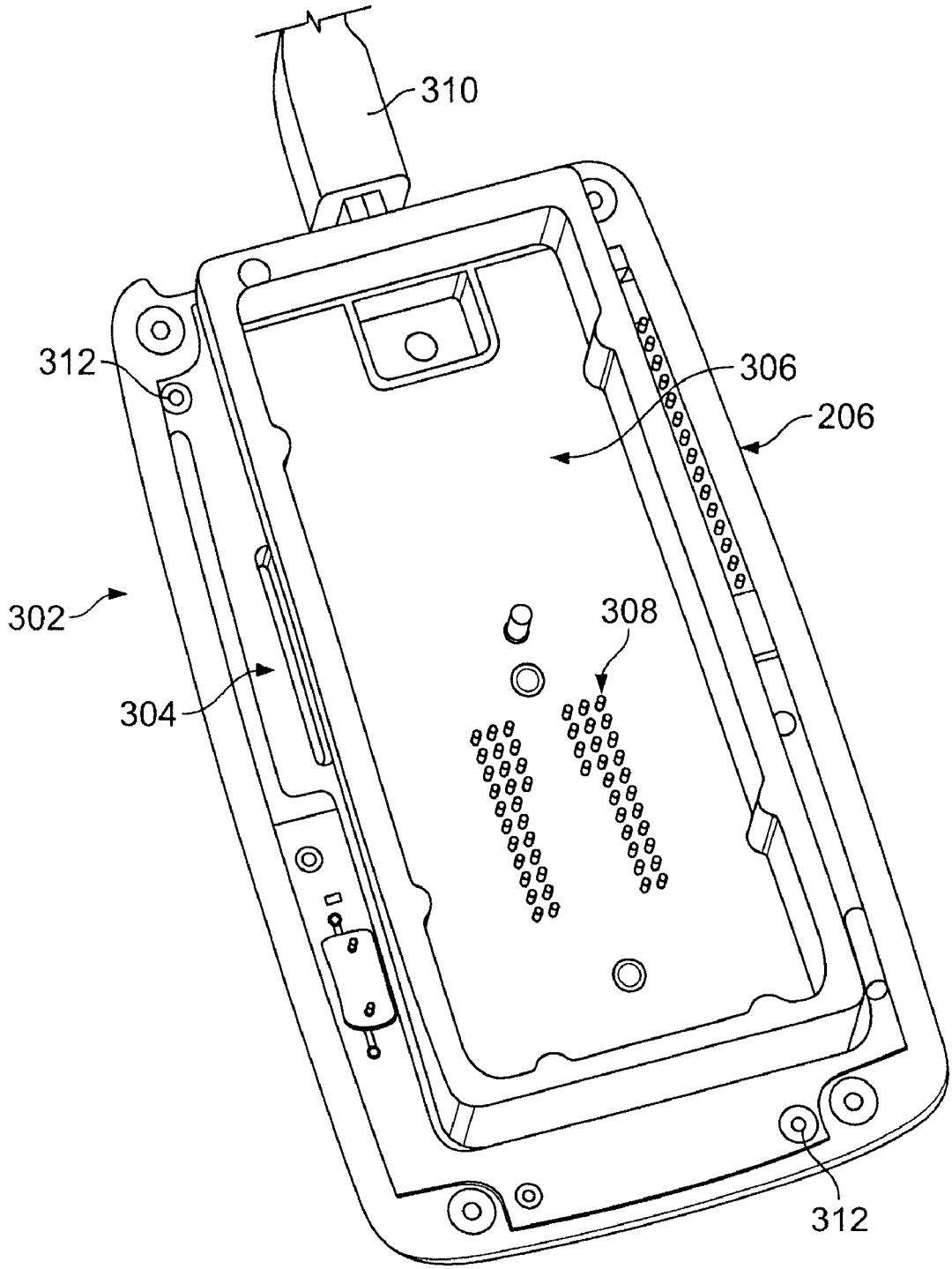
FIG. 3 is a perspective view of a printer cartridge testing device in accordance with another embodiment of the present invention.

For any given cartridge manufacturer (e.g., HP™, Lexmark™, etc.), there may be several different types of cartridges (black, color, photo color, etc.) produced by that manufacturer, and so the present invention contemplates different, interchangeable sockets for each different type or family of cartridge. For example, the socket 114 of the testing device 102 in FIG. 2 is designed to receive a certain family of Lexmark™ cartridges whereas the socket 306 of the device 302 of FIG. 3 is designed for certain HP™ cartridges. Note that the shape of the respective sockets 114, 306 as well as their respective pin configurations 214, 308 are considerably different in accordance with the different cartridges they are designed to accept. Regardless, and once again referring to FIG. 2, in addition to the contact pins 214, the socket 114 includes a cartridge detection switch 216. The cartridge detection switch 216 is disposed and positioned within the socket 114 such that insertion of a printer cartridge (having a profile matching that of the socket 114) actuates the switch 216. In this manner, the testing device 102 can detect when a cartridge is inserted into the socket 114 and thereby initiate a testing sequence or process as explained more fully below.

For any given cartridge manufacturer (e.g., HP™, Lexmark™, etc.), in addition to different types of cartridges (black, color, photo color, etc.), different types and sizes of cartridges 116 may include a sense line memory 118 that contains several bits of information. Illustratively, HP™ cartridge types 27 to 29 and 56 to 59 contain a sense line memory 118 with cartridge identification information stored by the manufacturer.

Some printers (not shown), in addition to using the information contained in the sense line memory 118 to monitor the level of ink within a specific cartridge 116, use the identification information to monitor the replacement of the cartridge after refill operations by comparing the new identification information of the replaced cartridge with the previously used cartridge. Some printers will, for example, cycle the identification information of the last several cartridges and refuse to acknowledge a new cartridge 116 if the identification information 118 read by the sensor 122 is still part of a queue of identification information stored in the memory of the printer (not shown). A sensor 122, used for detecting the amount of ink remaining in the cartridge 116, is also used to detect the identification information. A computer program 120 located on the testing device 102 selectively alters the cartridge identification information so as to override an empty reading by the sensor 120 when recycled cartridges 116 are placed in the device 100.

In another aspect of the present invention, an activity indicator 220 is also provided. The activity indicator 220 may be a blue light emitting diode or a similar device that indicates communication status of the device 102 with the computer (not shown). In one embodiment of the present invention, the activity indicator 220 is illuminated continuously when the testing device 102 is powered on and is in communication with the computer operating system via the computer interface. When the activity indicator 220 is flashing, data is being transferred to and from an application program residing or acting through the computer. Those having ordinary skill in the art will appreciate that other methods may be used to implement the activity indicator 220 and the present invention is not limited in this regard.

The housing 202 of the testing device 220 preferably includes one or more antistatic rails 218. The at least one antistatic rail 218 is located on one side of the housing 202 if a single rail is provided, or on opposite sides of the housing 202 if a pair of rails is provided. Each rail 218 is formed of a conductive wire, which may be stainless steel or any suitable electrically conductive material and, in one embodiment, is approximately 0.04" in diameter and connected to a frame ground provided by the computer interface, as described below. When the device 102 is held in an operator's hand, any static charge present is discharged through rails 218 to the computer interface ground, eliminating the possibility of damaging the device by static electricity entering through the contact pins or another site.

FIG. 3 shows a device 302 similar to that shown in FIG. 2 with only a lower portion 206 of the housing shown. In the example shown, the testing device 302 has a cartridge socket 306 and a specific test pin pattern 308 adapted for testing a family of HP™ cartridges. In a presently preferred embodiment, the socket 306 is attached to an adapter board 304 which is a printed circuit board including appropriate testing circuitry needed to test a specific cartridge or family of cartridges. In the illustrated embodiment, the adaptor board 304, including the socket 306, is fastened to a lower portion 206 of the housing by fasteners 312, which may be any suitable fastener, such as standard self tapping screws. As described in greater detail below, the adaptor board 304 is preferably in communication with a base board and may be interchanged with other adaptor boards adapted for testing of different printer cartridges. A cable 310 or other suitable connector (preferably communicating with the above-mentioned base board) for coupling the device 302 to a computer (not shown) is also illustrated.

As noted above, testing logic 110 is provided within each testing device 102 suitable for carrying out testing of one or more printer cartridges. Generally, the testing logic 110 may be implemented within a single component, such as a printed circuit board having the necessary subcomponents such as hardware, software and firmware elements. However, in a presently preferred embodiment, the testing logic 110 is preferably divided between a base board (comprising some or all of those components that are common to every testing device 102) and an adaptor board (comprising some or all of those components that are specific to a given printer cartridge or family of printer cartridges). This is further illustrated with reference to FIG. 4.

In particular, FIG. 4 illustrates a testing system 400 comprising a testing device 402 coupled to a computer 404. The computer 404, which may comprise any suitable computing device such as a desktop computer, a portable computer, a personal digital assistant, etc. generally comprises a processor 460 (such as a microprocessor, microcontroller, digital signal processor, co-processor, etc. or combinations thereof as known in the art) in communication with a memory 462 (including, but not limited to, volatile and/or non-volatile memory components or systems such as random access memory, read only memory, etc.). As known in the art, the processor 460 can execute instructions (applications or programs, including applications for interacting with and displaying data from the testing device 402) stored in the memory 462. Furthermore, as illustrated, the processor 460 communicates with an interface 464, various input/output devices 466 and a display 468.

As described below, the interface 464 provides and supports communication with the testing device 402 and, in presently preferred embodiment, supports a bidirectional data path 422, a power path 424 and a ground path 426. The data path 422 may adhere to any suitable data transfer protocol in accordance with an underlying physical media, such as a serial or parallel data bus. The power path 424 is coupled to a suitable power source (not shown) provided by power circuitry typically found in computers. Likewise, the ground path 426 is coupled to a common ground for the computer. The input/output devices 466 may include any device typically used for inputting (e.g., a keyboard, mouse, disk drive, optical drive, etc.) or outputting (e.g., disk drives, optical drives, speakers, annunciators, etc.) data, commands or any other information to/from a computer. A variety of other components typically found in computers are not shown in FIG. 4 for ease of illustration.

As shown, the testing device 402 preferably comprises a base board 406 in communication with an adaptor board 408. In a presently preferred embodiment, complementary connectors 420, 444 are respectively provided on both the base board 406 and adaptor board 408. The connectors 420, 444, which are preferably 30 pin connectors, mate together thereby supporting communications between the base board 406 and adaptor board 408. As shown, the base board 406 generally includes a host processor 412 and accompanying memory 414, which may comprise similar components to those described above concerning the computer's processor 460 and accompanying memory 462. In a presently preferred embodiment, host processor 412 and memory 414 are used to store/implement the necessary testing algorithms and computer interface 416 firmware. As described above, the computer interface 416 preferably comprises a USB interface integrated circuit which communicates with a suitable (female) USB connector, which integrated circuit and connector together form a USB interface. A particular advantage of a USB interface is that it supports the transfer of power 424 and ground 426 signals between devices. In this manner, the testing device 402 of the present invention does not need its own power source such as batteries or the like. Additionally, the base board 406 may further include a DC-to-DC converter 418 used to provide power to specific components within or coupled to the testing device 402. For example, in the case of a USB interface, the converter 418 converts five volt USB voltage to the twelve volts required to drive circuitry found on some cartridges.

Additional elements forming the base board 406 include a pair of switches 428, 430, preferably transistors, operating under the control (dotted lines) of the host processor 412. As described in greater detail below, the switches 428, 430 may be controlled to cause power to be routed to different portions of the test circuitry 440, and the cartridge being tested, as necessary. In particular, the second switch 430 may be controlled to switch power between one or more sensing lines 432 and a series resistor 434, described below. The host processor 412 can monitor the series resistor 434 using monitoring lines 436 coupled, for example, to an appropriate analog-to-digital converter (not shown). Likewise, one or more data lines 438 are provided to facilitate the transfer of data between the host processor 412 and one or more components on the adaptor board 408. Finally, an indicator 413, as described above, may operate under the control of the host processor 412.

As shown, the adaptor board 408 generally comprises test circuitry 440 interposed between the connector 444 and the socket 442. In turn, the socket 442 comprises the cartridge detection switch 448 and contact pins 450, as described above. The test circuitry 440 comprises any components necessary to provide test signals to and obtain test results from the particular type of printer cartridge for which the adaptor board 408 is configured. In a similar vein, the socket 442 and contact pins 450 together establish an interface that is unique to a given printer cartridge or family of printer cartridges. Because the adaptor board 408 is removably coupled to the base board 406 via the connectors 420, 444 (and any other suitable fasteners, etc. not shown), the present invention provides great flexibility for configuring the testing device 402 to be compatible with a wide variety of printer cartridges.

Figure 5:
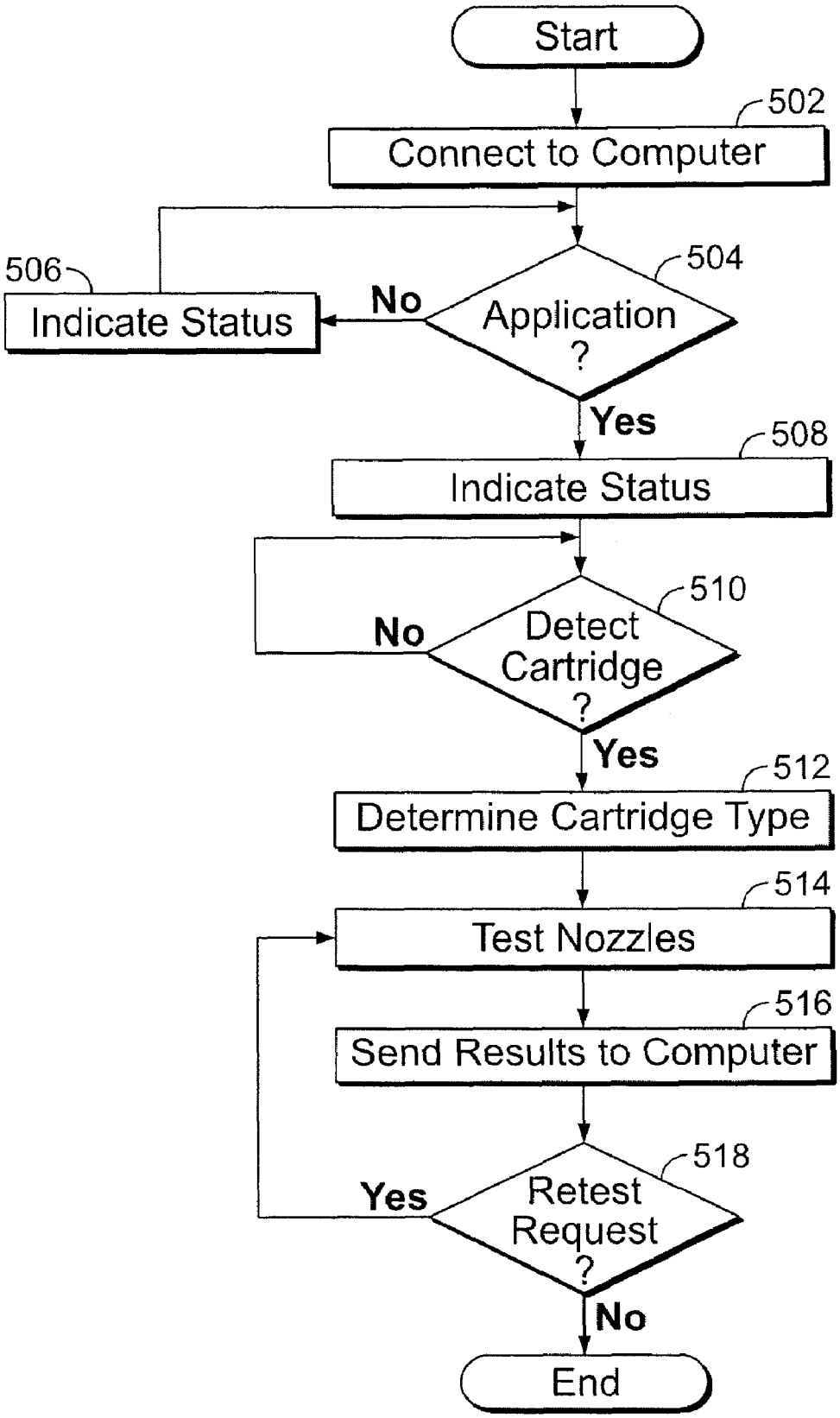
FIG. 5 is a flowchart illustrating operation of a printer cartridge testing device in accordance with the present invention.

Referring now to FIG. 5, operation of a testing device in accordance with the present invention is described in further detail. As an initial matter, it is assumed throughout the discussion of FIG. 5 that the testing device is physically coupled to a computer using any necessary cables or other connectors such that the necessary communication paths are established. Additionally, reference to specific components throughout the discussion of FIG. 5 are to those components illustrated in the preferred embodiment of FIG. 4 unless otherwise noted. However, it is to be understood that other testing devices architectures, departing from the specifics of the preferred embodiment of FIG. 4, may be equally employed. Thus, at block 502, the testing device first attempts to establish communications with the computer. Various techniques for establishing communications between a device and a compute are well known in the art and may be equally employed for purposes of the present invention. For example, in the case of a USB interface between the testing device and computer, the respective USB components within the testing device and computer can execute know protocols to recognize the existence of one another and thereby establish communications. Thereafter, the testing device, through its host processor, determines whether a suitable application is active on the computer, i.e., whether the program has been instantiated, at block 504. If the application program residing or acting through the computing device is not active, an appropriate status indicator is provided at block 506. For example, the activity indicator 220 may be lit continuously if the application is not detected. On the other hand, if the application program is running and in proper communication with the testing device, the activity indicator 220 can be caused to flash at block 508.

Once communications with the computer and application have been established, the cartridge detection switch is thereafter continuously monitored, for example, by the host processor, at block 510. When a user inserts a cartridge into the socket, the detection switch is actuated and sensed by the host processor. Thereafter, at block 512, the host processor configures the first switch 428 to power the converter 418 and the second switch 430 to supply the correct operating voltage (e.g., twelve volts) to the one or more sensing lines 432. As know in the art, each printer cartridge contains one or more sense lines that, when monitored correctly, can determine the type of cartridge, i.e., black, color, etc. Once determined, the information concerning the type of cartridge may be provided to the computer.

After the cartridge type is determined, processing continues at block 514 where testing of the printer cartridge is performed. Preferably, the nozzles of the printer cartridge are tested to determine whether they are electrically viable. To this end, the host processor controls the second switch 430 to route the output of the converter 418 (e.g., twelve volts) through the series resistor 434. Via the test circuitry 440, each nozzle heater is activated, preferably one by one. If the heater is operating normally, the series resistor 434 limits the current, causing a voltage drop to the cartridge. Using the monitoring lines 436 to monitor the level of this voltage drop, the host processor can sense whether or not the nozzle heater is malfunctioning as an open circuit. Conversely, when the nozzle heater is deactivated, the voltage level across the resistor should rise to a predetermined level in certain amount of time. If this does not happen, the heater has a lower than normal resistance and is deemed to be "over current", indicative of a short circuit.

Once the testing is completed, the test results, having been collected by the host processor, are sent to the computer and its resident application program via the computer interface at block 516. In one aspect of the present invention, it is possible for a user of the testing system to request retesting of a printer cartridge, typically as a consequence of unfavorable test results. This is illustrated at block 518 where it is determined whether a request to retest the printer cartridge has been received. This determination is made by the host processor by monitoring for messages sent by the computer. If a request to retest is received, processing continues at block 514 as described above; otherwise the process is complete.

Figure 6:
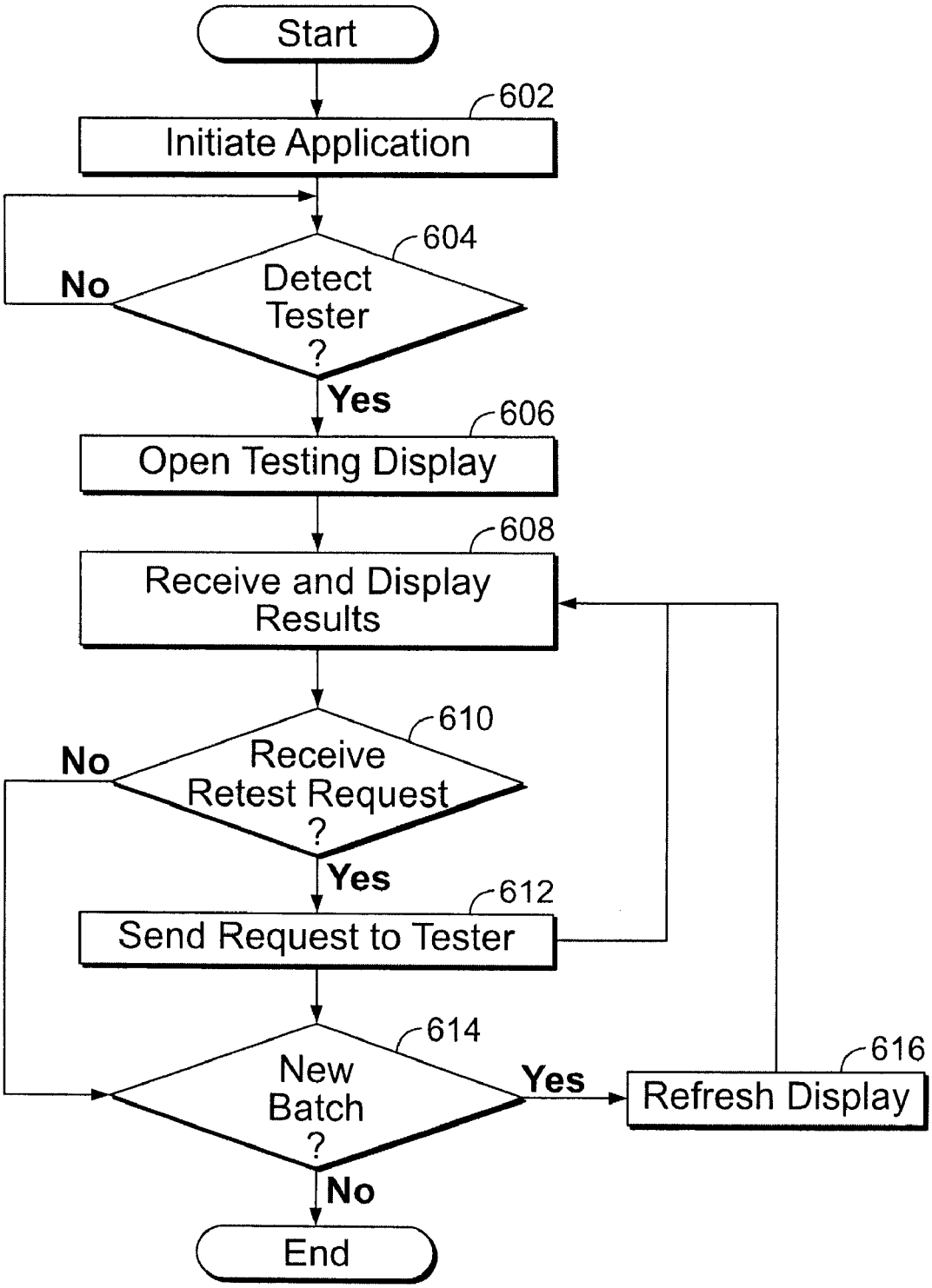
FIG. 6 is a flowchart illustrating operation of a computer that cooperates with a printer cartridge testing device in accordance with the present invention.

Referring now to FIG. 6, operation of a computer in accordance with the present invention, coupled to a printer cartridge testing device, is described in further detail. Once again, it is assumed throughout the discussion of FIG. 6 that the testing device is physically coupled to a computer such that the necessary communication paths are established and, furthermore, that reference to specific components throughout the discussion of FIG. 6 are to those components illustrated in the preferred embodiment of FIG. 4 unless otherwise noted, although this is not a requirement. It is further noted that the processing illustrated in FIG. 6 is preferably carried out by the computer's processor operating under the control of stored, executable instructions and with the possible inputs of a user of the computer, as noted below.

Processing begins at block 602 where an application used to interact with and display results received from a printer cartridge testing device, as described above, is initiated. Techniques for initiating such applications are well known to those having skill in the art and are typically determined by the specific type of operating system used by the computer. For example, on a computer using a Windows™ operating system, the user can manipulate a mouse-controlled cursor to double click an icon representative of the application, thereby causing the operating system to instantiate the application. For the purposes of the present invention, the application, at a minimum, may comprise any program that allows a user of the application to interact with the testing device and to display test results received from the testing device.

Figure 7:
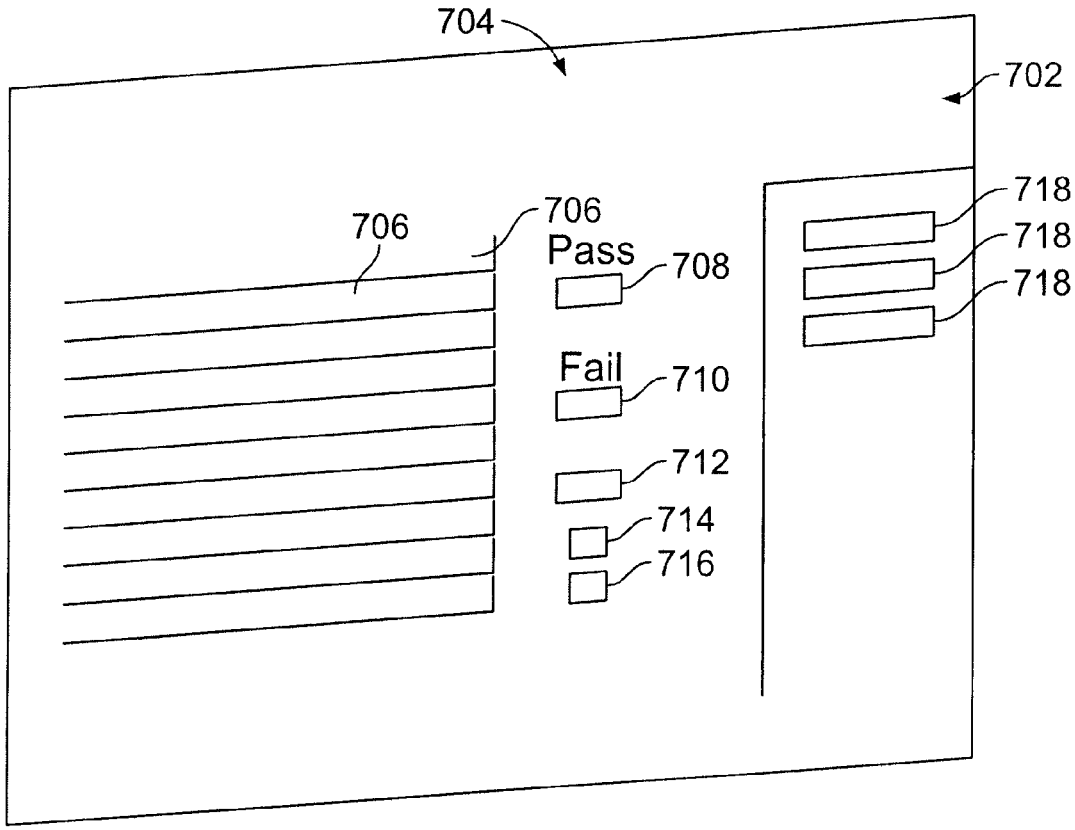
FIG. 7 is an illustration of an exemplary user interface displayed on a computer display showing various fields in accordance with the present invention.

Processing continues at block 604 where it is determined whether communications with the testing device have been established. As before, any of a number of well known techniques for establishing communications between a computer and a peripheral device, such as the testing device, may be equally employed, including the presently preferred USB interface and its corresponding protocols. It should be further noted that the illustrated sequence of blocks 602 and 604 is not a requirement as it may be possible to first establish communications with the testing device and then initiate the application. Regardless, the application program, once it detects a test device, preferably causes a user interface or testing display to be presented on a display of the computer at block 606. Techniques for providing and rendering such displays are well known to those having skill in the art. An exemplary user interface 704 is further illustrated in FIG. 7. As shown in FIG. 7, the user interface 704 is provided on the display screen 702 and comprises a variety of fields 706-718, some of which are capable of accepting user input, as described in further detail below. In a presently preferred embodiment, upon detecting the testing device, the application provide a visual indicator on the display indicating that the testing device has been detected, e.g., by turning a background color white or some other indicator color. Note that the user interface 704 shown is exemplary in nature and not intended to be limiting in any way, as it will be understood that the exact display of information is considered to be non-critical to the present invention and therefore, any suitable display of the information is contemplated.

At this point, the application is ready to receive test results from the testing device and display them in a suitable manner, as illustrated at block 608. Any of a number of data transfer protocols may be used to receive the testing data from the testing device, which test data may include an indication of the number of nozzle heaters that passed testing, the number of nozzles that failed testing due to an open circuit condition and the number of nozzles that failed testing due to a short circuit condition. Upon receipt, the test data is also preferably displayed on the computer such that the user of the testing system is made aware of the status of the cartridge under test. For example, if the test results show that all of the nozzle heaters passed the testing (e.g., no open or short circuits), the background color of the user interface may change color (to green, for example) and/or suitable text may be displayed. Additionally, and with reference to the exemplary embodiment of FIG. 7, the application may keep track of a number of cartridges being tested that have passed or failed testing, which numbers may be updated in corresponding pass or fail display fields 708, 710. Thus, when a cartridge passes testing, a number displayed in the pass field 708 is incremented by one. Conversely, if cartridge fails, the background color may change (to red, for example) and/or suitable text may be displayed, and a number displayed in the fail field 710 is incremented by one.

Additional display fields are illustrated in FIG. 7. For example, in the case where multiple testing devices are coupled to the computer running the application, multiple text boxes 706 uniquely corresponding to the multiple testing devices may be provided. In a presently preferred embodiment, up to ten testing device and, consequently, ten text boxes 706 may be employed. In this case, the background colors and pass/fail text referred to above is restricted to each text box 706 as test results from the corresponding testing device are received. Additionally, each text box 706 may display the type of cartridge under test, the number of currently functioning nozzles, and the number of malfunctioning nozzles. For example, the test results in any given text box 706 may be displayed in the following format: TYPE XX, YY OPEN, ZZ HIGH CURRENT, where xx is the cartridge type, yy is the number of nozzle failures due to open circuits, and zz is the number of nozzle failures due to short circuits. As noted above, the total number of passed/failed cartridges may be tallied in corresponding display fields 708, 710. In an alternate embodiment, the pass/fail display count 708, 710 may be displayed by cartridge type.

In a presently preferred embodiment, and with regard to the use of multiple testing devices, a user-selectable "new batch" button 712 is provided to clear the pass/fail boxes. Thus, upon completion of testing of a batch of cartridges, the tested cartridges may be removed and untested cartridges may be inserted into corresponding testing devices. In this manner, the present invention facilitates rapid testing of large numbers of printer cartridges. Furthermore, a user-selectable "print" button 716 is provided to execute a print screen function to provide a printed paper copy of the displayed test results. In an alternate embodiment, a printout report function that shows the pass/fail count listed by cartridge type may be provided. Further still, a plurality of text entry boxes 718 may be provided to allow text entry for tracking one or more batches of cartridges. For example, the boxes 718 may be labeled "Company," "Date," and "PO Number" to facilitate the entry of corresponding data. However, it is understood that any suitable nomenclature for the purpose of gathering user-relevant information may be equally provided.

Finally, in the presently preferred embodiment, a user-selectable "retest" button 714 is provided. Upon selection of the retest button 714, and referring once again to FIG. 6, processing continues at block 610 where it is determined that a request to retest has been received. In this case, the request to retest is provided to the testing device at block 612, and processing thereafter continues at block 608 as described above. In one embodiment of the present invention, particularly applicable to those instances in which multiple testing devices are coupled to a computer, a retest request will only be provided to those testing devices that indicated that its corresponding cartridge under test had failed. Alternatively, a user can instead select specific cartridges to be retested (e.g., through actuation of a selection mechanisms such as user-selectable buttons associated on the user interface with separate testing device and, hence, specific cartridges under test) such that subsequent selection of the retest button 714 causes provision of the retest request to the user-selected testing devices. In order to maintain an accurate count of passes and fails, selection of the retest button 714 preferably causes the last test total (either "pass" or "fail") to be decremented by one (or by whatever number of failed or user-selected cartridges are to be retested) so as to allow the same cartridge (or cartridges) to be retested. If a retest request is not received, processing continues at block 614 where it is determined whether the new batch button 712 has been selected. If so, processing continues at 616 where the display 704 is refreshed, and processing subsequently continues at block 608 as described above.

Thus, while the invention has been described with respect to certain preferred embodiments, it will be understood by those of skill in the art that there are modifications, substitutions and other changes that can be made, yet will still fall within the intended scope of the invention.

What is claimed is:

1. In a handheld device for testing printer cartridges, a method comprising:

establishing communication with a computer coupled to the handheld device;

detecting a printer cartridge coupled to the handheld device;

testing the printer cartridge to provide test results, including tests from the group consisting of fill level, test patterns, and circuit/nozzle heater integrity; and providing the test results to the computer.

2. The method of claim 1 further comprising:

providing an indicator corresponding to a communication status between the handheld device and the computer.

3. The method of claim 1, further comprising:

determining a type of the printer cartridge, wherein testing of the printer cartridge is based at least in part upon the type of the printer cartridge.

4. The method of claim 1, wherein testing the printer cartridge further comprises testing at least one nozzle of the printer cartridge.

5. The method of claim 1, further comprising:

receiving, from the computer, a request to retest the printer cartridge;

retesting the printer cartridge to provide retest results; and providing the retest results to the computer.

6. In a computer, a method for testing printer cartridges, the method comprising:

establishing communication with a handheld device, coupled to the computer, for testing printer cartridges;

receiving, from the handheld device, test results corresponding to a coupled printer cartridge tested by the device said test results including tests from the group consisting of fill level, test patterns and circuit/nozzle heater integrity; and displaying the test results.

7. The method of claim 6, further comprising:

initiating an application for interfacing with the handheld device and for displaying the test results.

8. The method of claim 6, further comprising:

receiving, via an input device, a request to retest the printer cartridge from a user of the computer;

sending the request to retest to the handheld device;

receiving retest results from the handheld device; and displaying the retest results.

9. In a handheld device for testing printer cartridges, the handheld device comprising a computer interface, a method comprising:

establishing communication with an external computer coupled to the handheld device via the computer interface;

detecting the printer cartridge coupled to the handheld device;

testing the printer cartridge to provide test results; and providing the test results to the computer via the computer interface.

10. The method of claim 9, further comprising:

providing an indicator corresponding to a communication status between the handheld device and the computer.

11. The method of claim 9, further comprising:

determining a type of the printer cartridge, wherein testing of the printer cartridge is based at least in part upon the type of the printer cartridge.

12. The method of claim 9, wherein testing the printer cartridge further comprises testing at least one nozzle of the printer cartridge.

13. The method of claim 9, further comprising:

receiving, from the computer, a request to retest the printer cartridge;

retesting the printer cartridge to provide retest results; and providing the retest results to the computer.

14. In a computer, a method for testing printer cartridges with a handheld device having a computer interface, the method comprising:

establishing communication with the handheld device via the computer interface, coupled to the computer, for testing printer cartridges;

receiving, from the handheld device via the computer interface, test results corresponding to a coupled printer cartridge tested by the device; and displaying the test results.

15. The method of claim 14, further comprising:

initiating an application for interfacing with the device and for displaying the test results.

16. The method of claim 14, further comprising:

receiving, via an input device, a request to retest the printer cartridge from a user of the computer;

sending the request to retest to the handheld device via the computer interface;

receiving retest results from the handheld device via the computer interface; and displaying the retest results.

* * * * *